US009201387B2

(12) United States Patent
Nakazawa

(10) Patent No.: US 9,201,387 B2
(45) **Date of Patent: *Dec. 1, 2015**

(54) IMAGE FORMING APPARATUS

(71) Applicant: Sharp Kabushiki Kaisha, Osaka (JP)

(72) Inventor: Shinji Nakazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/554,165

(22) Filed: Nov. 26, 2014

(65) Prior Publication Data

US 2015/0078782 A1 Mar. 19, 2015

Related U.S. Application Data

(63) Continuation of application No. 14/041,088, filed on Sep. 30, 2013, now Pat. No. 8,934,812, which is a continuation of application No. 12/895,975, filed on Oct. 1, 2010, now Pat. No. 8,571,439.

(30) Foreign Application Priority Data

Oct. 16, 2009 (JP) ..... 2009-239721
Oct. 19, 2009 (JP) ..... 2009-240794

(51) Int. Cl.
*G03G 21/16* (2006.01)
*G03G 15/16* (2006.01)

(52) U.S. Cl.
CPC ..... *G03G 21/1633* (2013.01); *G03G 15/161* (2013.01); *G03G 21/168* (2013.01); *G03G 2215/0132* (2013.01); *G03G 2221/169* (2013.01)

(58) Field of Classification Search
CPC ..... G03G 15/161; G03G 21/1633; G03G 21/168; G03G 2215/169
See application file for complete search history.

(56) References Cited

U.S. PATENT DOCUMENTS 7,302,209 B2 11/2007 Kurita
8,571,439 B2 10/2013 Nakazawa (Continued)

FOREIGN PATENT DOCUMENTS

JP 2004-020574 1/2004
JP 2008-216595 9/2008
JP 2008-250040 10/2008
JP 2009-251135 10/2009

OTHER PUBLICATIONS

Pending claims of co-pending related U.S. Appl. No. 14/561,264, filed Dec. 5, 2014.

(Continued)

*Primary Examiner* — Ryan Walsh
(74) *Attorney, Agent, or Firm* — Renner, Otto, Boisselle & Sklar, LLP

(57) ABSTRACT

In one embodiment of an image forming apparatus of the present invention, the image forming apparatus includes an opening/closing cover that is supported so as to be capable of moving relative to an image forming apparatus main body and opens/closes an opening portion of the image forming apparatus main body; and a unit installed so as to be capable of swinging on an image forming apparatus main body side of the opening/closing cover, in which when the opening/closing cover is opened/closed, the unit moves in a track that moves around a guide shaft of the unit, and in a track that moves so as to follow opening/closing of the opening/closing cover.

18 Claims, 11 Drawing Sheets

(56) References Cited

U.S. PATENT DOCUMENTS

| | | | | |
|---|---|---|---|---|
| 2004/0013452 | A1* | 1/2004 | Choi | 399/313 |
| 2006/0093397 | A1* | 5/2006 | Yamaoka | 399/110 |
| 2007/0212108 | A1* | 9/2007 | Hozono et al. | 399/121 |
| 2008/0080893 | A1 | 4/2008 | Asahina et al. | |
| 2008/0138111 | A1* | 6/2008 | Ju et al. | 399/121 |
| 2008/0240780 | A1 | 10/2008 | Yamauchi | |
| 2009/0022514 | A1* | 1/2009 | Fujiwara et al. | 399/121 |

OTHER PUBLICATIONS

Allowed claims of co-pending related U.S. Appl. No. 14/041,028, filed Sep. 30, 2013.

Allowed claims of co-pending related U.S. Appl. No. 14/041,088, filed Sep. 30, 2013.

* cited by examiner

IMAGE FORMING APPARATUS

CROSS-REFERENCE TO RELATED APPLICATIONS

This application claims priority under 35 U.S.C. §119(a) on Patent Application No. 2009-239721 filed in Japan on Oct. 16, 2009, and Patent Application No. 2009-240794 filed in Japan on Oct. 19, 2009, the entire contents of which are herein incorporated by reference.

BACKGROUND OF THE INVENTION

The present invention relates to an image forming apparatus in which, for example, a unit such as a secondary transfer unit is installed on an image forming apparatus main body side of an opening/closing cover.

Recently, electrophotographic image forming apparatuses that are capable of forming a multi-color image, such as color copy machines, color printers, and so forth, have been developed.

As electrophotographic image forming apparatuses, for example, intermediate transfer-type color image forming apparatuses are known in which image forming is performed by forming toner images of each color on image carriers such as photosensitive drums, sequentially layering and transferring the toner images of each color to an intermediate transfer belt serving as an intermediate transfer body to form a multi-color image, and then transferring that multi-color image to a recording paper serving as a transfer paper in a nip portion between the intermediate transfer belt and a transfer belt of a secondary transfer unit, and fixing the multi-color image.

In this intermediate transfer-type color image forming apparatus, the secondary transfer unit is provided on an image forming apparatus main body side of a cover capable of opening/closing relative to an opening portion of the image forming apparatus main body, so when a paper jam occurs in the nip portion, the jammed paper can be removed by opening the cover.

In JP 2004-20574A (referred to below as Patent Document 1), a configuration is disclosed in which a secondary transfer roller is provided in an opening/closing cover, and such that a shaft of the transfer roller can be received and thus positioned by a guide provided in the intermediate transfer belt when the opening/closing cover has been closed, the transfer roller shaft is guided along a path in a straight line joining the shaft of the transfer roller and a shaft of a drive roller of the intermediate transfer belt.

Incidentally, in an image forming apparatus in which the secondary transfer unit has been mounted on the image forming apparatus main body side of the opening/closing cover having a fulcrum, in consideration of contact between the rotational track of the secondary transfer unit and other components of the image forming apparatus main body side, it is necessary for the rotational fulcrum to be set at a position as far as possible to the image forming apparatus main body side from the secondary transfer unit, or to enlarge the rotational radius, or the like. Therefore, in design it is necessary to secure sufficient distance between the secondary transfer unit and components on the image forming apparatus main body side.

On the other hand, also when the opening/closing cover has been opened/closed parallel to the image forming apparatus main body via a slide rail or the like rather than a rotational fulcrum, there is the problem of, for example, contact between components on the image forming apparatus main body side and the secondary transfer belt.

In Patent Document 1, when providing a transfer-related member on the back side of the opening/closing cover, it is conceivable that the size in the height direction is restricted in the rotational track of the transfer-related member when opening/closing the opening/closing cover.

Also, in an image forming apparatus in which the secondary transfer unit has been mounted on the image forming apparatus main body side of the opening/closing cover, a transfer pressing contact load is applied as-is to the secondary transfer unit, and because that load is applied to the opening/closing cover, there is a risk of deformation of the opening/closing cover when closing the opening/closing cover.

As a specific example, as shown in FIG. 11, assuming that a pressing force (transfer pressing contact load) of 6 kg is applied to a secondary transfer unit 1000, a load of 3 kg is applied on both the upper side and the lower side of the opening/closing cover where the secondary transfer unit 1000 has been mounted (installed) on the image forming apparatus main body side.

In order to achieve increased strength of the opening/closing cover, for example, it is necessary to prevent deformation with a separate member such as a metal frame or the like. However, this leads to increased cost and weight and so forth, and in the worst case it is conceivable that it will not be possible to secure secondary transfer pressure.

In Patent Document 1, because the load of the transfer roller is applied as-is to the opening/closing cover, the opening/closing cover bulges, and in order to prevent that bulging it is necessary to increase the strength of the opening/closing cover itself.

SUMMARY OF THE INVENTION

The present invention has been made in view of the technical problems as described above, and it is an object thereof to provide an image forming apparatus in which, when a unit has been installed on an image forming apparatus main body side of an opening/closing cover, it is possible to make the image forming apparatus main body compact even when another component is provided in the vicinity of the unit. It is a further object of the invention to provide an image forming apparatus in which it is possible to prevent deformation of the opening/closing cover without achieving increased strength of the opening/closing cover itself.

In order to attain the above objects, in an image forming apparatus according to the present invention, an image forming apparatus is presumed that includes an opening/closing cover that is supported so as to be capable of moving relative to the image forming apparatus main body and opens/closes an opening portion of the image forming apparatus main body, and a unit installed so as to be capable of swinging on an image forming apparatus main body side of the opening/closing cover, in which when the opening/closing cover is opened/closed, the unit moves in a track that moves around a guide shaft of the unit, and in a track that moves so as to follow opening/closing of the opening/closing cover.

According to the above configuration, when an operation to open the opening/closing cover is performed, the track of the unit and the track of the opening/closing cover differ during a predetermined period, so even if, for example, another component such as a fixing unit is provided above the unit, it is possible to make the image forming apparatus main body compact.

The image forming apparatus according to the present invention, in addition to the above configuration, may include a pressing force bearing member for allowing at least part of a pressing force applied to the unit to be borne on the image forming apparatus main body side when the opening/closing cover has been closed.

According to the above configuration, it is possible to allow at least part of a pressing force applied to the unit to be borne on the image forming apparatus main body side when the opening/closing cover has been closed, so when the unit is installed on the image forming apparatus main body side of the opening/closing cover, it is possible to prevent deformation of the opening/closing cover without achieving increased strength of the opening/closing cover itself.

Specifically, a configuration may be adopted in which the pressing force bearing member is provided in the image forming apparatus main body, and includes a guide member where a notch has been formed on an extension of the movement track of the unit when a closing operation of the opening/closing cover is performed, and a guide shaft provided in the unit, and the guide shaft of the unit enters into the notch of the guide member when the opening/closing cover has been closed.

According to the above configuration, when the opening/closing cover has been closed, the guide shaft of the unit enters into the notch of the guide member, so it is possible to reliably allow at least part of a pressing force applied to the unit to be borne on the image forming apparatus main body side.

Also, it is preferable that the movement track of the unit is a track in which, during an opening operation of the opening/closing cover, the unit moves around the guide shaft that has entered into the notch of the guide member, and after the guide shaft has departed from the notch, the unit moves following movement of the opening/closing cover.

According to this configuration, when an operation to open the opening/closing cover is performed, the track of the unit and the track of the opening/closing cover differ during a predetermined period, so even if, for example, a fixing unit is provided above the unit, it is possible to make the image forming apparatus main body compact.

Also, in the above image forming apparatus, the opening direction of the notch of the guide member intersects the direction of operation of pressing force received by the unit.

According to the above configuration, the opening direction of the notch of the guide member intersects the direction of operation of pressing force received by the unit, so when closing the opening/closing cover, the guide shaft of the unit does not separate from the guide member. Accordingly, part of the pressing force received by the unit can be efficiently borne on the image forming apparatus main body side. Also, there is no loss of speed when closing the opening/closing cover.

Also, in the above image forming apparatus, in the unit, relative to the opening/closing cover, one side is supported by a shaft so as to be movable, and the other side is in a free state, and thus the unit is able to swing.

According to the above configuration, the unit is able to swing relative to the opening/closing cover, so the guide shaft of the unit easily enters into the notch of the guide member.

In one mode, the opening/closing cover is movable in a straight line in the horizontal direction relative to the image forming apparatus main body.

In another mode, the opening/closing cover is rotatable around a fulcrum relative to the image forming apparatus main body.

Furthermore, in the above image forming apparatus, the unit is a secondary transfer unit, further including an image carrier and an intermediate transfer unit that transfers a toner image on a surface of the image carrier to a paper.

According to the above configuration, because the transfer pressing contact load from the intermediate transfer unit is not applied to the opening/closing cover from the secondary transfer unit, which has been installed on the image forming apparatus main body side of the opening/closing cover, there is no risk of deformation of the opening/closing cover when closing the opening/closing cover.

Moreover, in the above image forming apparatus, a configuration may be adopted in which when the opening/closing cover has been closed, the secondary transfer unit is positioned above a transfer nip between the secondary transfer unit and the intermediate transfer unit, and the secondary transfer unit is supported by the guide member below the transfer nip.

According to the above configuration, when the opening/closing cover has been closed, the secondary transfer unit is positioned above a transfer nip between the secondary transfer unit and the intermediate transfer unit, and the secondary transfer unit is supported by the guide member below the transfer nip, so the ability to bear the pressing force applied to the secondary transfer unit on the image forming apparatus main body side increases.

In addition, in the above image forming apparatus, it is preferable that the distance between the transfer nip and the point where the secondary transfer unit is supported by the guide member is longer than the distance between the transfer nip and the point where the secondary transfer unit is held by the opening/closing cover.

In the above configuration, as the distance between the transfer nip and the point where the secondary transfer unit is supported by the guide member increases, it is possible to reduce the pressing force applied to the opening/closing cover by the secondary transfer unit.

Furthermore, in the image forming apparatus of the present application, from another viewpoint, in the movement track of the unit, during an opening operation of the opening/closing cover, the absolute height of the unit temporarily decreases and then increases.

Here, "absolute height of the unit" refers to the height from the surface where the image forming apparatus is placed to the unit.

According to the above configuration, even if, for example, a fixing unit or the like is provided above the unit, it is possible to make the image forming apparatus main body compact.

Also, in the above image forming apparatus, a configuration may be adopted in which a fixing apparatus is further provided above the secondary transfer unit on the image forming apparatus main body side, and during an opening operation of the opening/closing cover, the secondary transfer unit moves in a direction separating from the fixing apparatus.

According to the above configuration, when an operation to open the opening/closing cover is performed, the track of the secondary transfer unit and the track of the opening/closing cover differ during a predetermined period, so even if, for example, a fixing apparatus is provided above the secondary transfer unit, it is possible to make the image forming apparatus main body compact.

Also, in the above image forming apparatus, a configuration may be adopted in which the secondary transfer unit is provided with at least a secondary transfer belt and a secondary transfer roller.

DESCRIPTION OF THE PREFERRED EMBODIMENTS

Hereinafter, an embodiment(s) of the present invention will be described in detail based on the accompanying drawings.

Overall Configuration

Figure 1:
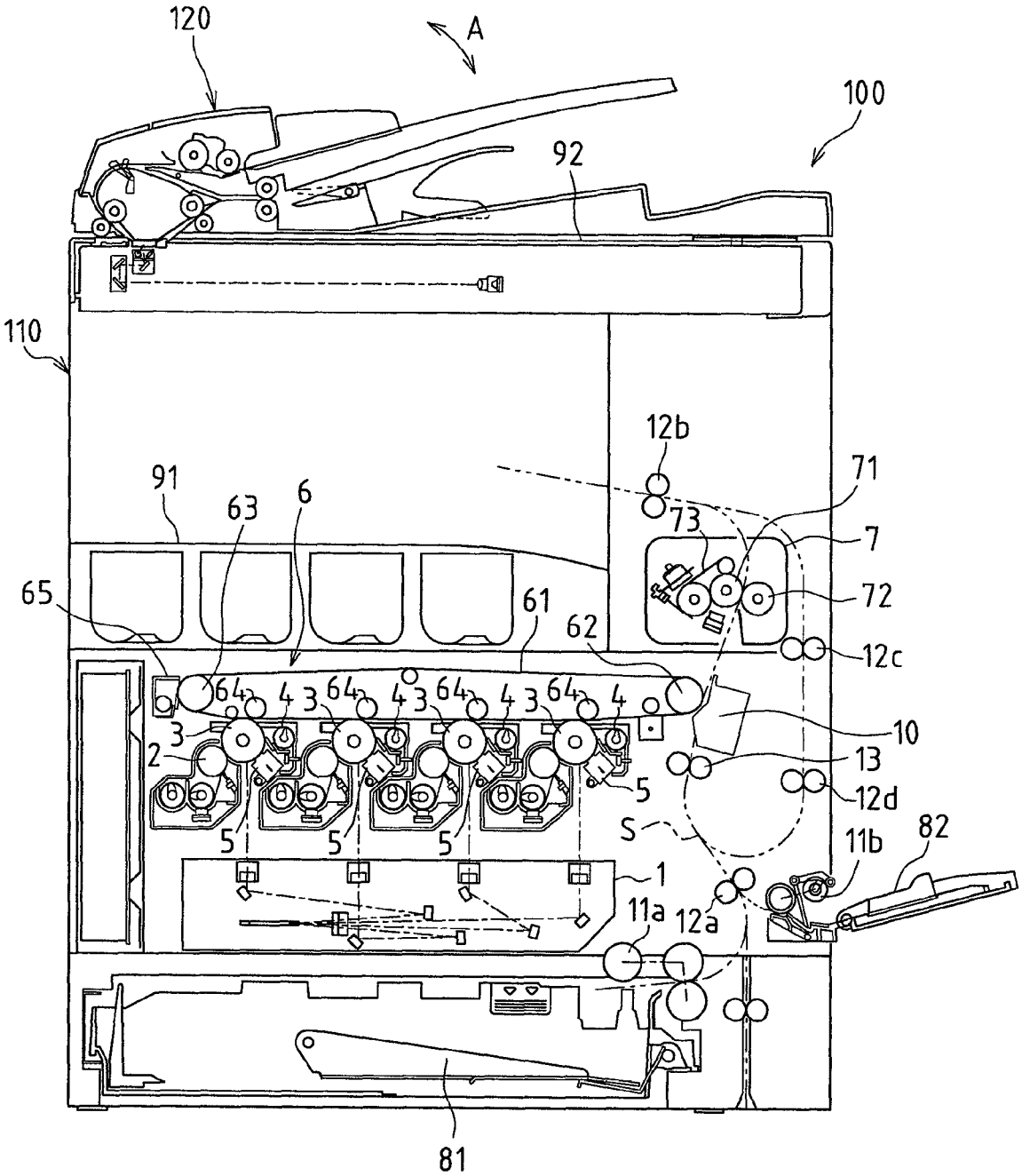
FIG. 1 is a schematic diagram showing a simplified view of the overall configuration of an image forming apparatus according to an embodiment of the present invention.

FIG. 1 is a schematic diagram showing a simplified view of the overall configuration of an image forming apparatus 100 according to an embodiment of the present invention.

As shown in FIG. 1, the image forming apparatus 100 of the present embodiment forms multi-color and single-color images on predetermined sheets (recording paper) according to image data that has been transmitted from outside, and is configured with an image forming apparatus main body 110 and an automatic document processing apparatus 120.

The image forming apparatus main body 110 is configured having an exposure unit 1, development units 2, photosensitive drums 3, cleaning units 4, charging units 5, an intermediate transfer unit 6, a fixing unit 7, a paper cassette 81, a discharge tray 91, and so forth.

An original placement stage 92 constituted from a light-transmitting glass where an original is to be placed is provided in the upper portion of the image forming apparatus main body 110, and the automatic document processing apparatus 120 is installed on the upper side of the original placement stage 92.

The automatic document processing apparatus 120 automatically transports an original on the original placement stage 92. Also, the automatic document processing apparatus 120 is configured to be capable of rotating in the direction of arrow A, and configured such that an original can be placed by hand by opening the space above the original placement stage 92.

Image data handled in this image forming apparatus 100 corresponds to color images employing each of the colors black (K), cyan (C), magenta (M), and yellow (Y). Accordingly, four each of the development units 2, the photosensitive drums 3, the charging units 5, and the cleaning units 4 are provided and respectively set to black, cyan, magenta, and yellow, so as to form four types of latent images corresponding to each color. With these components, four image stations are configured.

The charging units 5 are charging means for uniformly charging the surface of the photosensitive drums 3 to a predetermined potential. Other than a charger-type charging unit as shown in FIG. 1, a contact-type charging unit such as a roller-type or brush-type charging unit is sometimes also used.

The exposure unit 1 is configured with a laser scanning unit (LSU) having a laser emitting unit, reflecting mirrors, and so forth. Optical elements such as a polygon mirror where a laser beam is scanned, and a lens and mirrors for guiding laser light that has been reflected by the polygon mirror to the photosensitive drums 3, are disposed in the exposure unit 1. Otherwise, a technique employing, for example, an EL or LED write head in which light-emitting elements are lined up in an array can also be adopted. This sort of exposure unit 1 has a function of, by exposing the charged photosensitive drums 3 according to image data that has been input, forming electrostatic images corresponding to the image data on the surfaces of the photosensitive drums 3.

The development units 2 use toners of four colors (Y, M, C, K) to make visible the electrostatic latent images that have been formed on the respective photosensitive drums 3.

The cleaning units 4 remove and recover toner remaining on the surfaces of the photosensitive drums 3 after development and image transfer have been performed.

The intermediate transfer unit 6 is disposed above the photosensitive drums 3. This intermediate transfer unit 6 is provided with an intermediate transfer belt 61, an intermediate transfer belt drive roller 62, an intermediate transfer belt idler roller 63, intermediate transfer rollers 64, and an intermediate transfer belt cleaning unit 65. Four of the intermediate transfer rollers 64 are provided, respectively corresponding to the four colors Y, M, C, and K.

The intermediate transfer belt 61 is stretched across the intermediate transfer belt drive roller 62, the intermediate transfer belt idler roller 63, and the intermediate transfer rollers 64, and is rotationally driven. The intermediate transfer rollers 64 confer a transfer bias for transferring the toner images of the photosensitive drums 3 onto the intermediate transfer belt 61.

The intermediate transfer belt 61 is provided so as to make contact with each of the photosensitive drums 3. A color toner image (multi-color toner image) is formed on the intermediate transfer belt 61 by sequentially layering and transferring the toner images of each color that have been formed on the photosensitive drums 3 onto the intermediate transfer belt 61. The intermediate transfer belt 61, for example, is formed in an endless shape using a film having a thickness of about 100 to 150 μm.

Transfer of toner images from the photosensitive drums 3 to the intermediate transfer belt 61 is performed by the intermediate transfer rollers 64, which are in contact with the back side of the intermediate transfer belt 61. A high voltage transfer bias (a high voltage of opposite polarity (+) as the toner charging polarity (−)) for transferring toner images is applied to the intermediate transfer rollers 64.

The intermediate transfer rollers 64 are rollers in which a metal (for example, stainless steel) shaft having a diameter of 8 to 10 mm is used as a base, and the surface of that shaft is covered with an electrically conductive elastic material (for example, such as EPDM or urethane foam). With this conductive elastic material, it is possible to uniformly apply a high voltage to the intermediate transfer belt 61. In the present embodiment, a roller shape is used for transfer electrodes, but otherwise a brush or the like can also be used.

As described above, electrostatic images made visible corresponding to each color on the respective photosensitive drums 3 are layered on the intermediate transfer belt 61. Thus, layered image information is transferred onto the paper by rotation of the intermediate transfer belt 61, and a secondary transfer belt 210 (see FIG. 2) of a secondary transfer unit 10 disposed at a contact position of the paper and the intermediate transfer belt 61, described below. At this time, the intermediate transfer belt 61 and the secondary transfer belt 210 make pressing contact at a predetermined nip.

Also, as described above, toner affixed to the intermediate transfer belt 61 due to contact with the photosensitive drums 3, or toner remaining on the intermediate transfer belt 61 without being transferred onto the paper by the secondary transfer belt 210, causes toner color mixing to occur in a subsequent process, so a setting is adopted such that this toner is removed and collected by the intermediate transfer belt cleaning unit 65.

The intermediate transfer belt cleaning unit 65 is provided with, for example, a cleaning blade serving as a cleaning member that contacts the intermediate transfer belt 61, and the intermediate transfer belt 61 contacted by the cleaning blade is supported from the back side by the intermediate transfer belt idler roller 63.

The paper cassette 81 is a tray for stockpiling sheets (recording paper) used for image forming, and is provided below the exposure unit 1 of the image forming apparatus main body 110. Sheets used for image forming can also be placed in a manual paper cassette 82. Furthermore, the discharge tray 91 provided in the upper portion of the image forming apparatus main body 110 is a tray for accumulating, face-down, sheets on which printing has been performed.

Also provided in the image forming apparatus main body 110 is an approximately vertically shaped paper transport path S for feeding sheets from the paper cassette 81 and the manual paper cassette 82 via the secondary transfer unit 10 and the fixing unit 7 to the discharge tray 91. Pickup rollers 11*a* and 11*b*, a plurality of transport rollers 12*a*, 12*b*, 12*c*, and 12*d*, registration rollers 13, the secondary transfer unit 10, the fixing unit 7, and so forth are disposed in the vicinity of the paper transport path S from the paper cassette 81 or the manual paper cassette 82 to the discharge tray 91.

The transport rollers 12*a* to 12*d* are small rollers for promoting and assisting sheet transport, and a plurality of these are provided along the paper transport path S.

The pickup roller 11*a* is provided near one end of the paper cassette 81, and picks up sheets page-by-page from the paper cassette 81 and supplies them to the paper transport path S. Likewise, the pickup roller 11*b* is provided near one end of the manual paper cassette 82, and picks up sheets page-by-page from the manual paper cassette 82 and supplies them to the paper transport path S.

The registration rollers 13 temporarily hold a sheet being transported through the paper transport path S, and have a function of transporting the sheet to the secondary transfer unit 10 at a timing such that a leading edge of the toner images on the photosensitive drums 3 matches the leading edge of the sheet.

The fixing unit 7 is provided with a heat roller 71 and a pressure roller 72, and the heat roller 71 and the pressure roller 72 rotate while sandwiching a sheet.

The heat roller 71 is set by a control unit to become a predetermined fixing temperature based on a signal from an unshown temperature detection unit, and has a function of, together with the pressure roller 72, by applying toner to a sheet with heat and pressure, melting, mixing, and making pressing contact against a multi-color toner image that has been transferred to the sheet, thus performing thermo-compression bonding of the multi-color toner image to the sheet. Also, an external heating belt 73 for heating the heat roller 71 from outside is provided.

Next is a detailed description of the sheet transport path.

As described above, the paper cassette 81 and the manual paper cassette 82 where sheets are stored in advance are provided in the image forming apparatus 100. In order to supply sheets from the paper cassettes 81 and 82, the pickup rollers 11*a* and 11*b* are disposed, and guide sheets page-by-page to the transport path S.

Sheets transported from the respective paper cassettes 81 and 82 are transported to the registration rollers 13 by the transport rollers 12*a* in the paper transport path S, and are transported to the secondary transfer unit 10 at a timing such that the leading edge of a sheet matches the leading edge of the image information on the intermediate transfer belt 61, and the image information is written onto the sheet. Then, by the sheet passing through the fixing unit 7, unfixed toner on the sheet is melted and fixed with heat, and then discharged onto the discharge tray 91 via the transport rollers 12*b* disposed thereafter.

The above transport path is used when there is a request for simplex printing to sheets. On the other hand, when there is a request for duplex printing, as described above, once the trailing edge of a sheet that has finished simplex printing and passed through the fixing unit 7 has been grasped by the final transport rollers 12*b*, the sheet is guided to the transport rollers 12*c* and 12*d* by the transport rollers 12*b* rotating in reverse. Afterward, the sheet passes through the registration rollers 13 and printing is performed on the back side of the sheet, and then the sheet is discharged to the discharge tray 91.

Configuration of Secondary Transfer Unit 10

Figure 2:
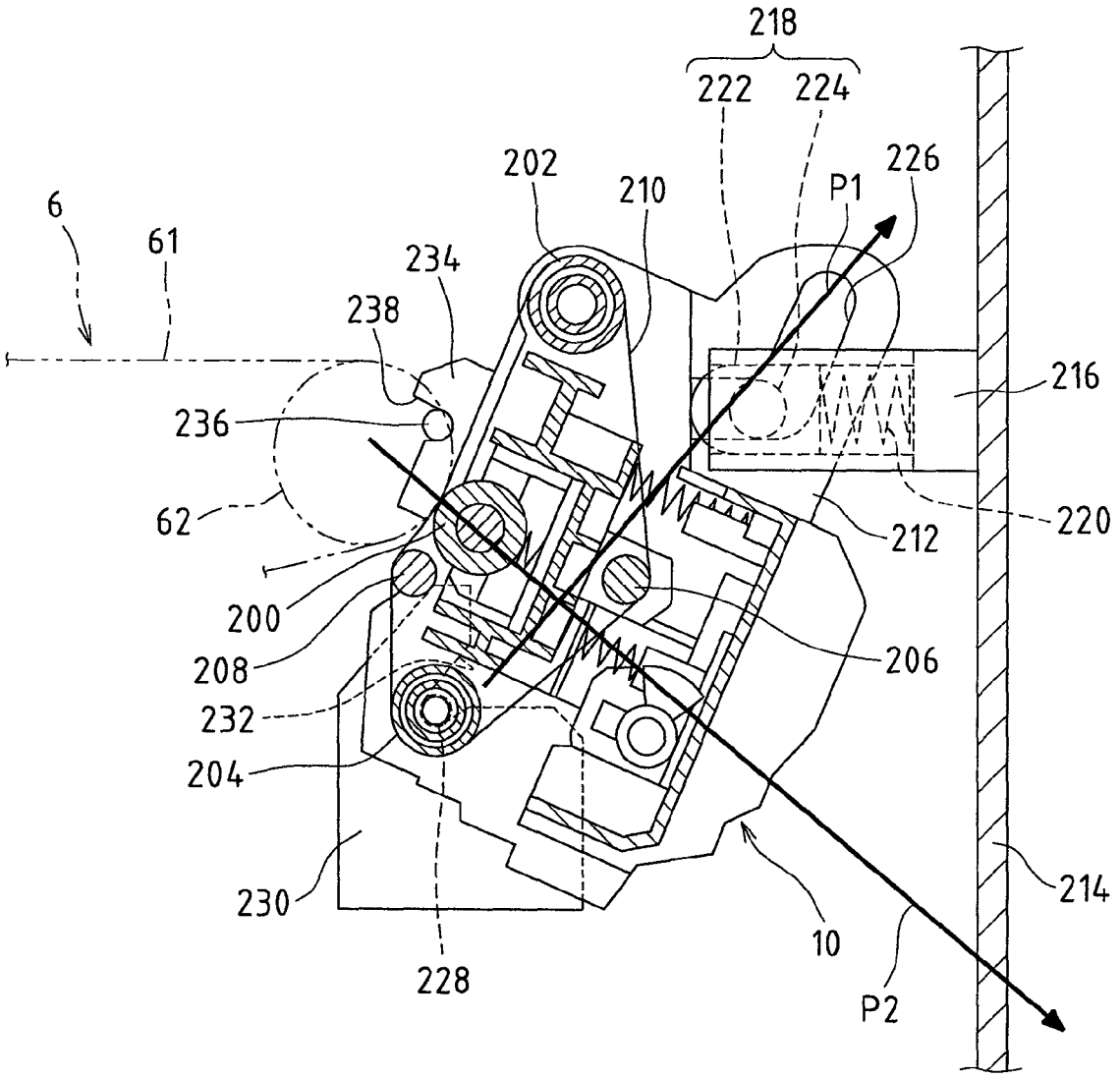
FIG. 2 is a cross-sectional view showing the configuration of a secondary transfer unit applied in an embodiment of the present invention.

FIG. 2 is a cross-sectional view of the configuration of the secondary transfer unit 10.

As shown in FIG. 2, the secondary transfer unit 10 includes a secondary transfer roller 200, a drive roller 202, an idler roller 204, tension rollers 206 and 208, the secondary transfer belt 210, and so forth.

A voltage for transferring toner to paper is applied to the secondary transfer roller 200 (a high voltage of opposite polarity (+) as the toner charging polarity (−)). In order to steadily obtain the above nip, either the secondary transfer roller 200 or the above intermediate transfer belt drive roller 62 is made of a hard material (such as metal), and the other is a roller made of a soft material such as an elastic roller (such as an elastic rubber roller or a foam resin roller).

The secondary transfer roller 200, the drive roller 202, the first tension roller 206, the idler roller 204, and the second tension roller 208 are disposed in this order clockwise from the secondary transfer roller 200.

The secondary transfer belt 210 has an endless shape, and is wrapped around the secondary transfer roller 200, the drive roller 202, the idler roller 204, and the tension rollers 206 and 208. The respective roller shafts of the secondary transfer roller 200, the drive roller 202, the idler roller 204, and the tension rollers 206 and 208 are supported by a left-right pair of frames 212. In FIG. 2, only the back-side frame of the frames 212 is shown.

The secondary transfer unit 10 is installed on the image forming apparatus main body 110 side of an opening/closing cover 214 that opens/closes an opening portion of the image forming apparatus main body 110. In the secondary transfer unit 10, relative to the opening/closing cover 214, one side (the opening/closing cover 214 side) is supported by a shaft so as to be movable, and the other side (the intermediate transfer unit 6 side) is in a free state. Thus, the secondary transfer unit 10 is able to swing.

Specifically, a receiving member 216 that receives the frames 212 of the secondary transfer unit 10 is fixed on the image forming apparatus main body 110 side of the opening/closing cover 214. The receiving member 216 has a box-like shape, and housed therein are a support shaft member 218 for supporting the frames 212 of the secondary transfer unit 10, and a pressing contact spring 220 that biases the support shaft member 218 to the intermediate transfer unit 6 side.

The support shaft member 218 is configured from a support shaft member main body 222 that slides within the receiving member 216, and a support shaft 224 provided protruding toward the frames 212 of the secondary transfer unit 10 from the side faces of the support shaft member main body 222. The support shaft member main body 222 and the support shaft 224 are provided as a single body.

The pressing contact spring 220 is a spring for pressing the secondary transfer belt 210 of the secondary transfer unit 10 against the intermediate transfer belt 61 of the intermediate transfer unit 6, and is interposed between the support shaft member main body 222 and a rear wall of the receiving member 216. That is, one end of the pressing contact spring 220 is attached to the rear wall of the receiving member 216, and the other end is attached to a rear wall of the support shaft member main body 222.

On the other hand, a slit 226 is formed on one side (the opening/closing cover 214 side) in the frames 212 of the secondary transfer unit 10. This slit 226 has a shape bent towards the opening/closing cover 214 side, and the support shaft 224 of the support shaft member 218 is inserted therein.

Figure 3A:
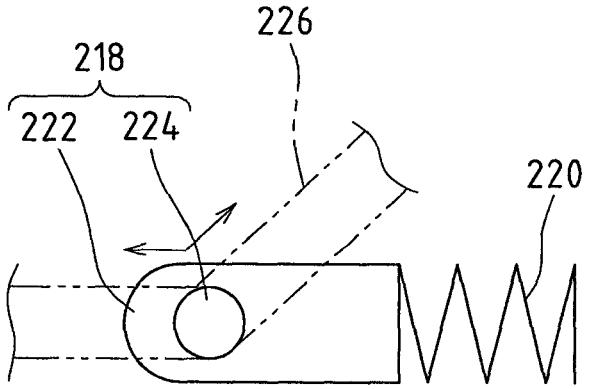
FIG. 3A is a front view showing a simplified view of a state in which a support shaft of a support shaft member has been inserted into a slit of a secondary transfer unit frame of the secondary transfer unit shown in FIG. 2.
Figure 3B:
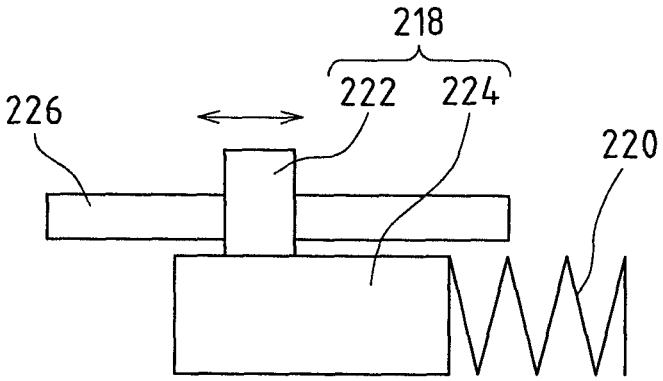
FIG. 3B is a top view likewise showing a simplified view of a state in which the support shaft of the support shaft member has been inserted into the slit of the secondary transfer unit frame.

Also, as shown in FIGS. 3A and 3B, as the secondary transfer unit 10 swings, the support shaft 224, which is provided as a single body with the support shaft member main body 222 made movable relative to the opening/closing cover 214, moves within the slit 226 of the frames 212 of the secondary transfer unit. That is, the secondary transfer unit 10 is supported so as to be capable of swinging relative to the opening/closing cover 214 by the support shaft 224 moving within the slit 226.

Returning to FIG. 2, in the frames 212 of the secondary transfer unit 10, a guide shaft 228 is provided protruding at the other end side (the opposite side as the area where the slit 226 is formed). This guide shaft 228 is disposed on about the same axis as the roller shaft of the idler roller 204. On the other hand, a guide member 230 that guides the secondary transfer unit 10 when the opening/closing cover 214 is closed is provided in the image forming apparatus main body 110. In this guide member 230, a notch 232 is formed at a position where the guide shaft 228 is introduced, on an extension of the movement track of the secondary transfer unit 10 when a closing operation of the opening/closing cover 214 is performed. Thus, when the opening/closing cover 214 has been closed, the guide shaft 228 of the secondary transfer unit 10 enters into the notch 232 of the guide member 230.

In the present embodiment, an opening direction P1 of the notch 232 of the guide member 230 is orthogonal to direction P2 of operation of pressing force received by the secondary transfer unit 10.

Furthermore, in the frames 212 of the secondary transfer unit 10, a positioning member 234 is provided at an edge portion on the secondary transfer roller 200 side. On the other hand, in the image forming apparatus main body 110, a positioning boss 236 is provided above the vicinity of the transfer nip of the intermediate transfer belt 61 and the secondary transfer belt 210. A notch 238 that opens toward the positioning boss 236 is formed in the positioning member 234. Thus, when, along with a closing operation of the opening/closing cover 214, the guide shaft 228 of the secondary transfer unit 10 has entered into the notch 232 of the guide member 230, the notch 238 of the positioning member 234 on the secondary transfer unit 10 side engages with the positioning boss 236 on the image forming apparatus main body 110 side, and thus the secondary transfer unit 10 is positioned at a desired position.

That is, in the present embodiment, when the opening/closing cover 214 has been closed, the secondary transfer unit 10 is positioned above the transfer nip between the secondary transfer unit 10 and the intermediate transfer unit 6, and the secondary transfer unit 10 is supported by the guide member 230 below the transfer nip.

Also, in the present embodiment, the distance from the transfer nip to the point where the secondary transfer unit 10 is supported by the guide member 230 is set to be longer than the distance from the transfer nip to the point where the secondary transfer unit 10 is held by the opening/closing cover 214.

Configuration of Opening/Closing Cover 214

Figure 4:
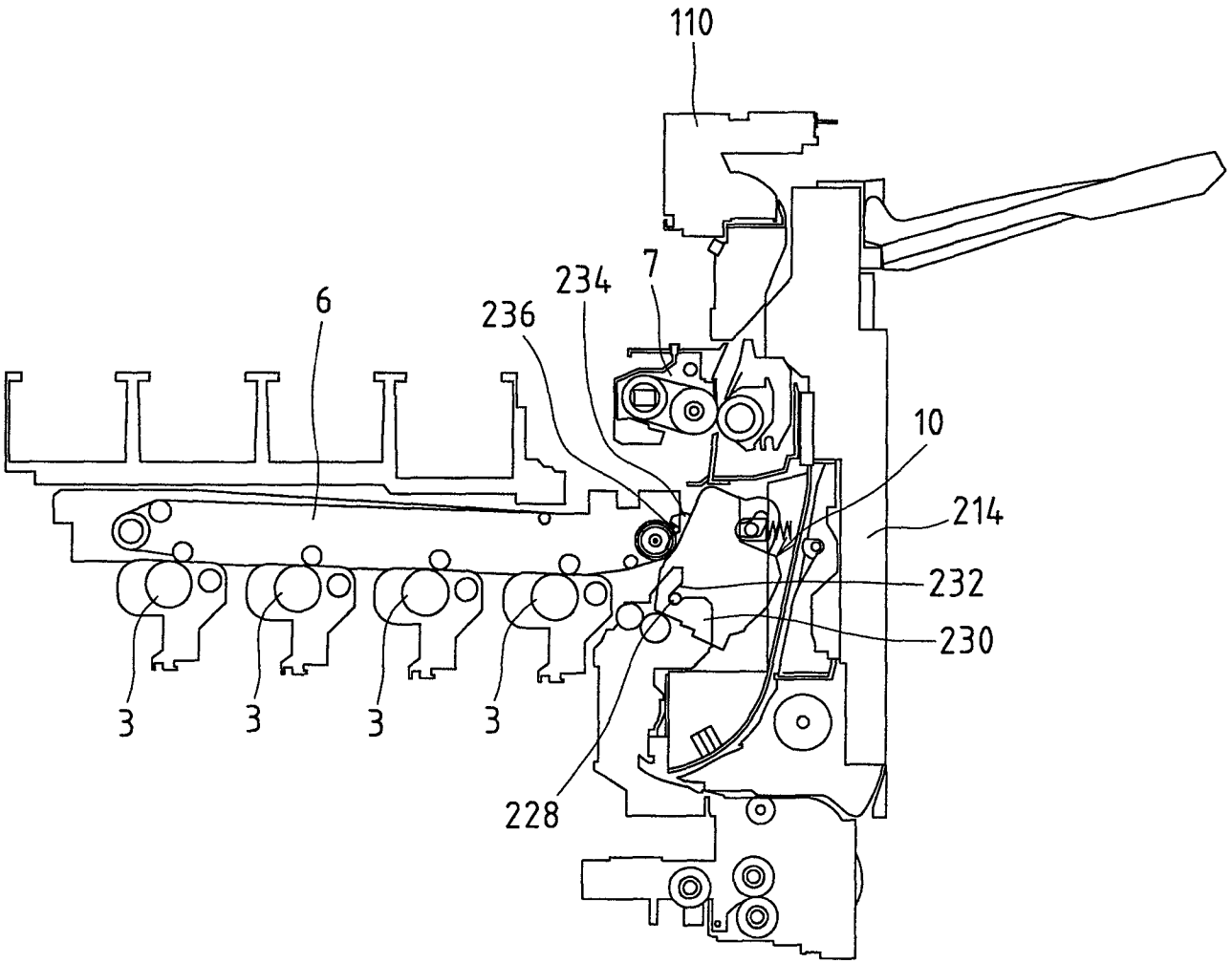
FIG. 4 shows a state in which an Accuride-type opening/closing cover applied in an embodiment of the present invention is closed.
Figure 5:
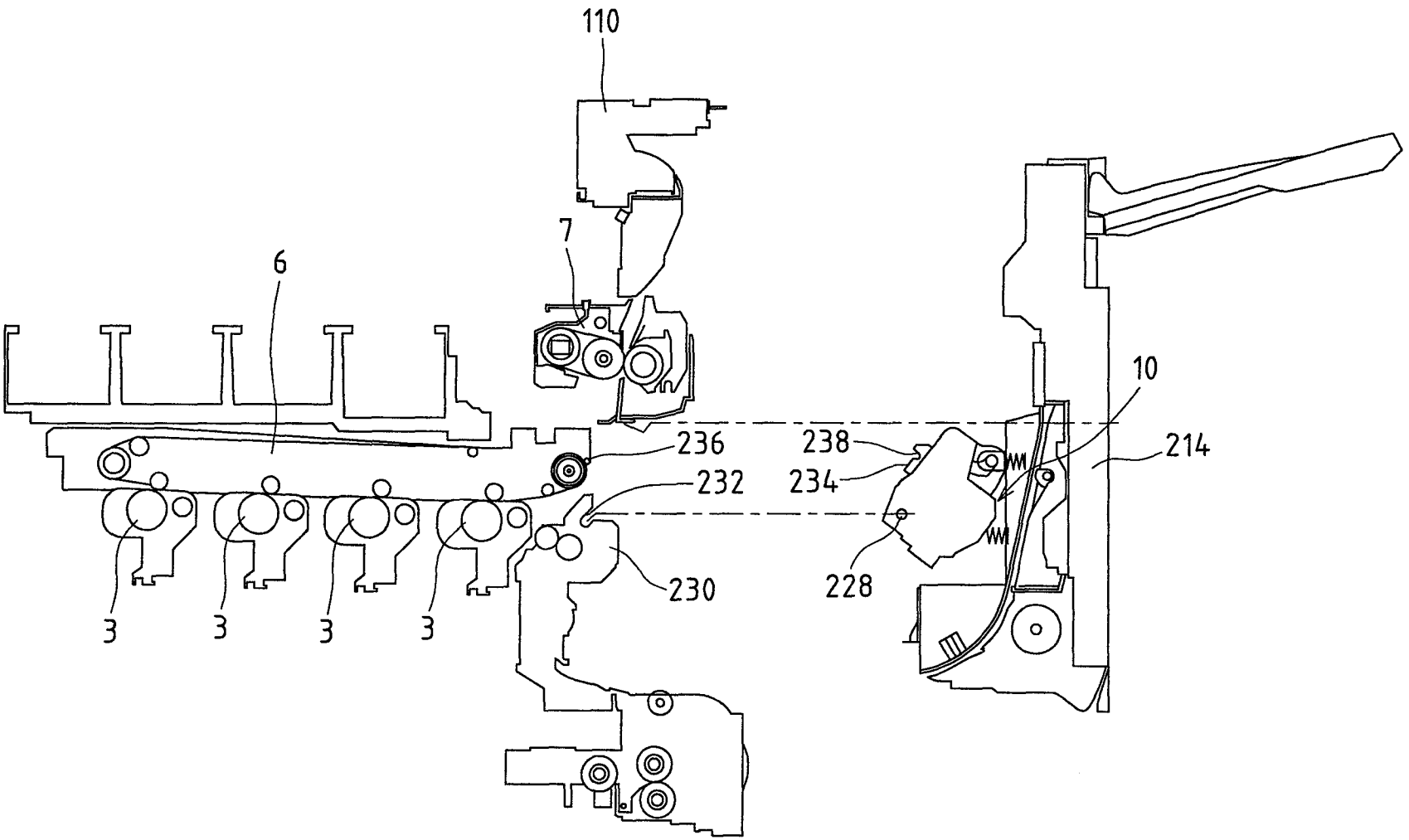
FIG. 5 shows a state in which an Accuride-type opening/closing cover applied in an embodiment of the present invention is open.
Figure 7:
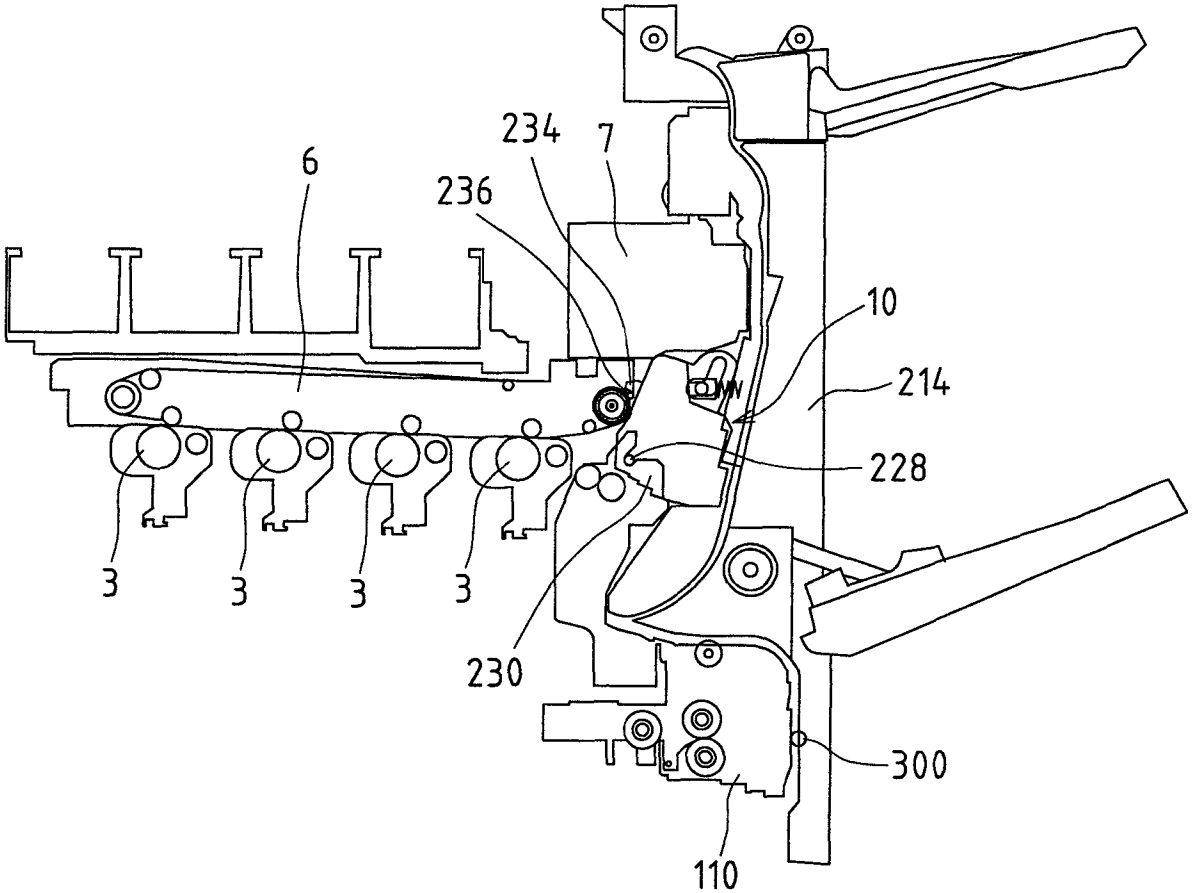
FIG. 7 shows a state in which a fulcrum-type opening/closing cover applied in an embodiment of the present invention is closed.
Figure 8:
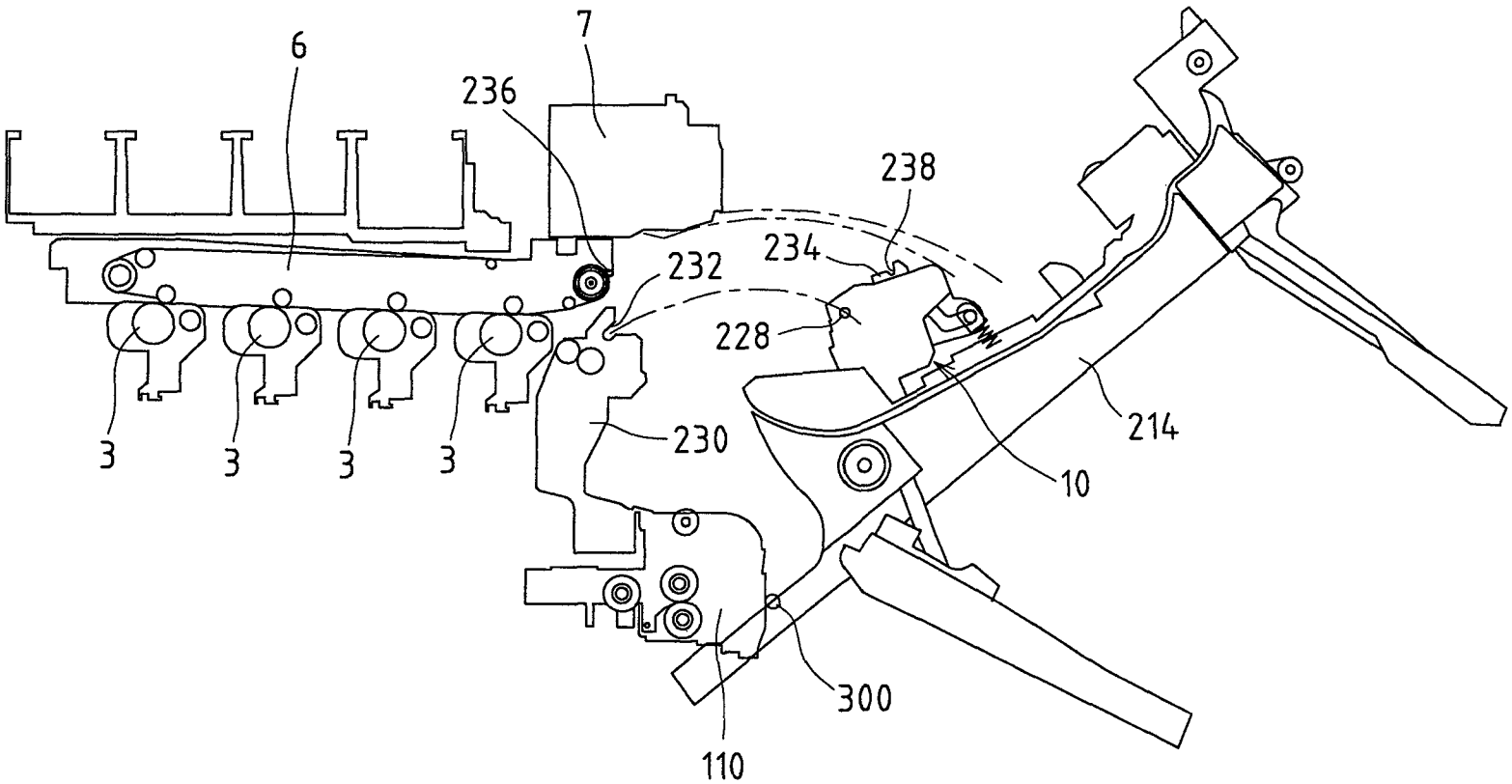
FIG. 8 shows a state in which a fulcrum-type opening/closing cover applied in an embodiment of the present invention is open.

As shown in FIGS. 4 and 5, the opening/closing cover 214 may be an Accuride-type opening/closing cover that is movable in a straight line in the horizontal direction relative to the image forming apparatus main body 110, or as shown in FIGS. 7 and 8, the opening/closing cover 214 may be a fulcrum-type opening/closing cover that is rotatable around a fulcrum 300 relative to the image forming apparatus main body 110.

Operation when Opening Accuride-Type Opening/Closing Cover 214

Figure 6A:
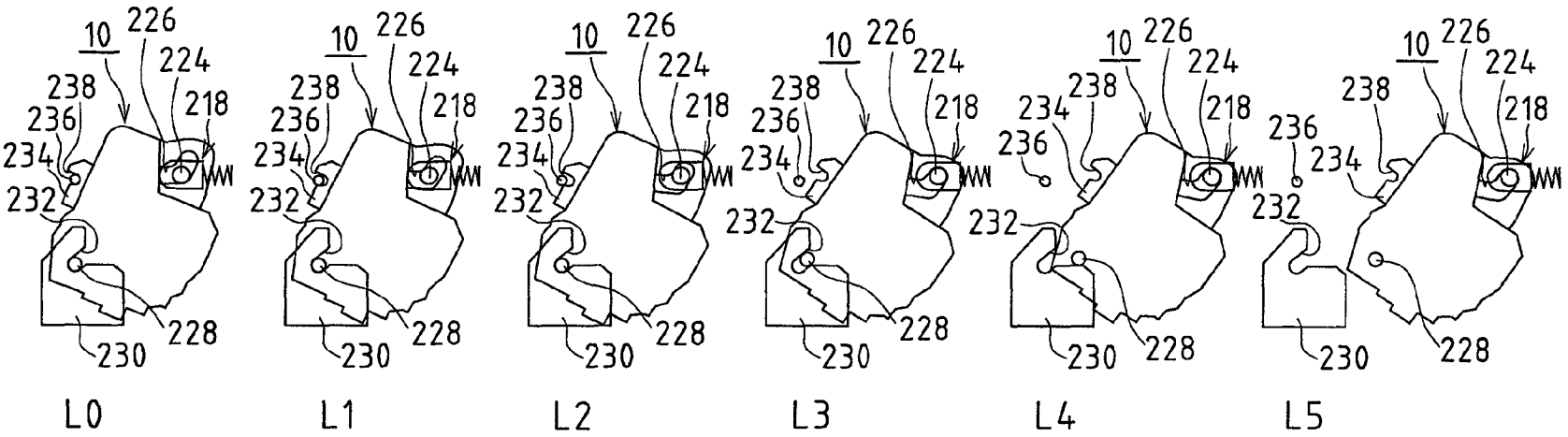
FIG. 6A shows a track in which a secondary transfer unit moves due to an opening operation of an Accuride-type opening/closing cover applied in an embodiment of the present invention.
Figure 6B:
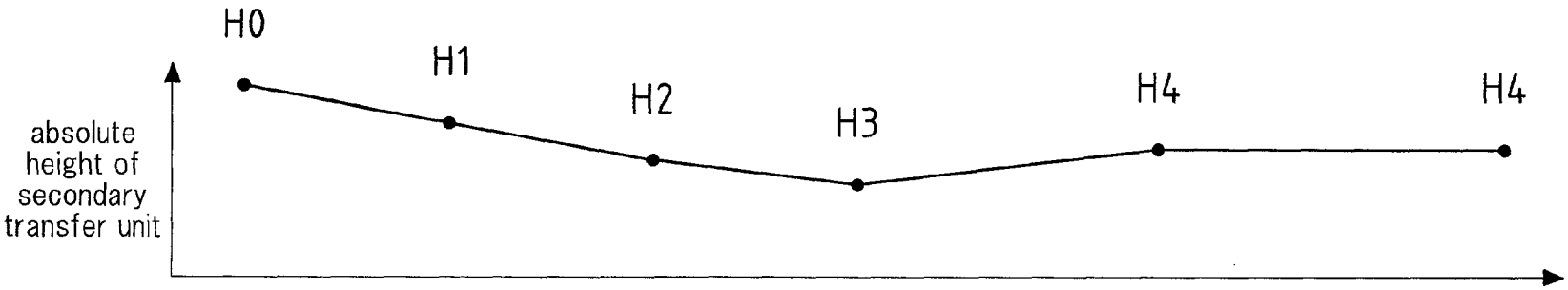
FIG. 6B shows a transition in absolute height of a secondary transfer unit during an opening operation of an Accuride-type opening/closing cover applied in an embodiment of the present invention.

FIG. 6A shows a track in which the secondary transfer unit 10 moves due to an opening operation of the Accuride-type opening/closing cover 214, and FIG. 6B shows a transition in absolute height of the secondary transfer unit 10 during the operation to open the Accuride-type opening/closing cover 214. Here, "absolute height of the secondary transfer unit 10" refers to the height from the surface where the image forming apparatus 100 is placed to the secondary transfer unit 10.

As shown in FIG. 6A, at a closed position L0 of the Accuride-type opening/closing cover 214, the guide shaft 228 of the secondary transfer unit 10 has entered into the notch 232 of the guide member 230, and also the notch 238 of the positioning member 234 of the secondary transfer unit 10 is engaged with the positioning boss 236.

When the opening/closing cover 214 is moved horizontally in the opening direction from this state, up to a cover open position L2 (for example, 5 mm), the secondary transfer unit 10 rotates clockwise around the guide shaft 228, and at the time when the cover open position of the opening/closing cover 214 has arrived at L2, the notch 238 of the positioning member 234 of the secondary transfer unit 10 is separated from the positioning boss 236. During this operation, the absolute height of the secondary transfer unit 10, as shown in FIG. 6B, gradually decreases in the manner of H0→H1 (<H0)→H2 (<H1), where H0 is the point of maximum height.

As shown in FIG. 6A, from the cover open position L2 where the notch 238 of the positioning member 234 of the secondary transfer unit 10 separates from the positioning boss 236, when the opening/closing cover 214 is further moved horizontally in the opening direction so that the cover open position of the opening/closing cover 214 arrives at L3 (for example, 10 mm), the support shaft 224 of the support shaft member 218 moves to the upper portion of the slit 226 of the secondary transfer unit 10. During this operation, the absolute height of the secondary transfer unit 10, as shown in FIG. 6B, gradually decreases in the manner of H2→H3 (<H2). Once the open position L3 of the opening/closing cover 214 is passed, the guide shaft 228 of the secondary transfer unit 10 starts to withdraw from the notch 232 of the guide member 230.

As shown in FIG. 6A, when the opening/closing cover 214 is further moved horizontally in the opening direction until the cover open position changes from L3 to L4 (for example, 15 mm), the guide shaft 228 of the secondary transfer unit 10 is completely removed from the guide member 230. During this operation, the absolute height of the secondary transfer unit 10, as shown in FIG. 6B, gradually increases in the manner of H3→H4(>H3), where H3 is the point of minimum height.

As shown in FIG. 6A, from the cover open position L4 where the guide shaft 228 of the secondary transfer unit 10 is completely separated from the guide member 230, when the opening/closing cover 214 is further moved horizontally in the opening direction so that the cover open position of the opening/closing cover 214 arrives at L5 (for example, 20 mm), during this operation, the secondary transfer unit 10 moves horizontally following the movement track of the opening/closing cover 214. That is, in the transition after the guide shaft 228 of the secondary transfer unit 10 has completely separated from the guide member 230 at the cover open position L4, the absolute height of the secondary transfer unit 10 remains unchanged at H4.

As is clear from the above description, when the opening/closing cover 214 is opened/closed, the secondary transfer unit 10 installed on the image forming apparatus main body 110 side of the opening/closing cover 214 moves in a different track than the movement track of the opening/closing cover 214. Specifically, when performing an operation to open the opening/closing cover 214, the secondary transfer unit 10 rotates around the guide shaft 228, which has entered into the notch 232 of the guide member 230, and after the guide shaft 228 has departed from the notch 232 of the guide member 230, the secondary transfer unit 10 moves following movement of the opening/closing cover 214. Thus, the absolute height of the secondary transfer unit 10, which follows the opening operation of the opening/closing cover 214, temporarily decreases and then increases. In this way, during the opening operation of the opening/closing cover 214, because the track of the opening/closing cover 214 differs from the track of the secondary transfer unit 10 during a predetermined period of time (in other words, during the opening operation of the opening/closing cover 214, the secondary transfer unit 10 moves in the direction separating from the fixing unit 7), so the image forming apparatus main body 110 can be made compact even when the fixing unit 7 is provided above the secondary transfer unit 10.

Also, in the secondary transfer unit 10, relative to the opening/closing cover 214, one side is supported by a shaft so as to be movable, and the other side is in a free state. Thus, the secondary transfer unit 10 is able to swing, so when closing the opening/closing cover 214, the guide shaft 228 of the secondary transfer unit 10 easily enters into the notch 232 of the guide member 230.

Operation when Opening Fulcrum-Type Opening/Closing Cover 214

Figure 9A:
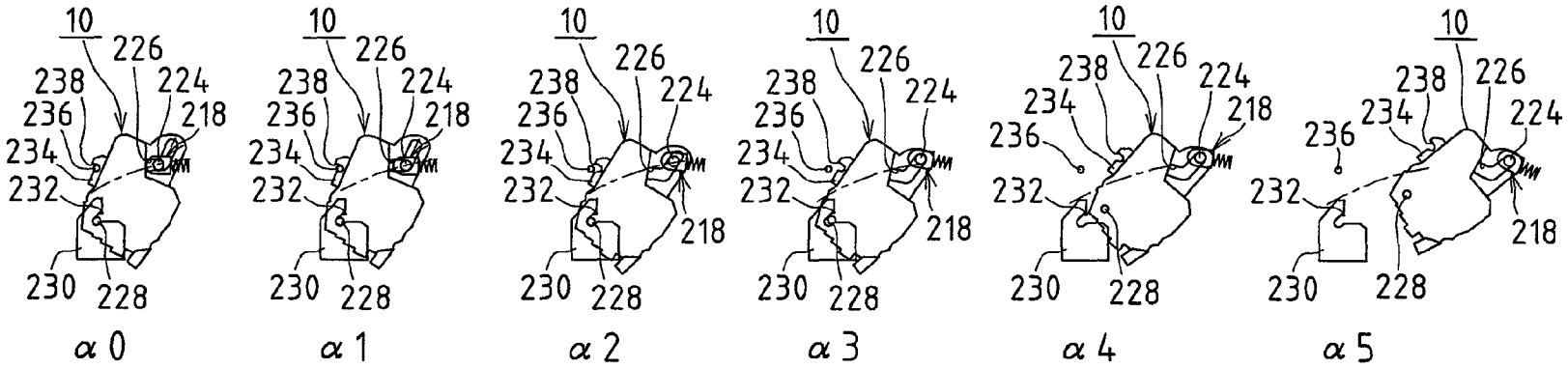
FIG. 9A shows a track in which a secondary transfer unit moves due to an opening operation of a fulcrum-type opening/closing cover applied in an embodiment of the present invention.
Figure 9B:
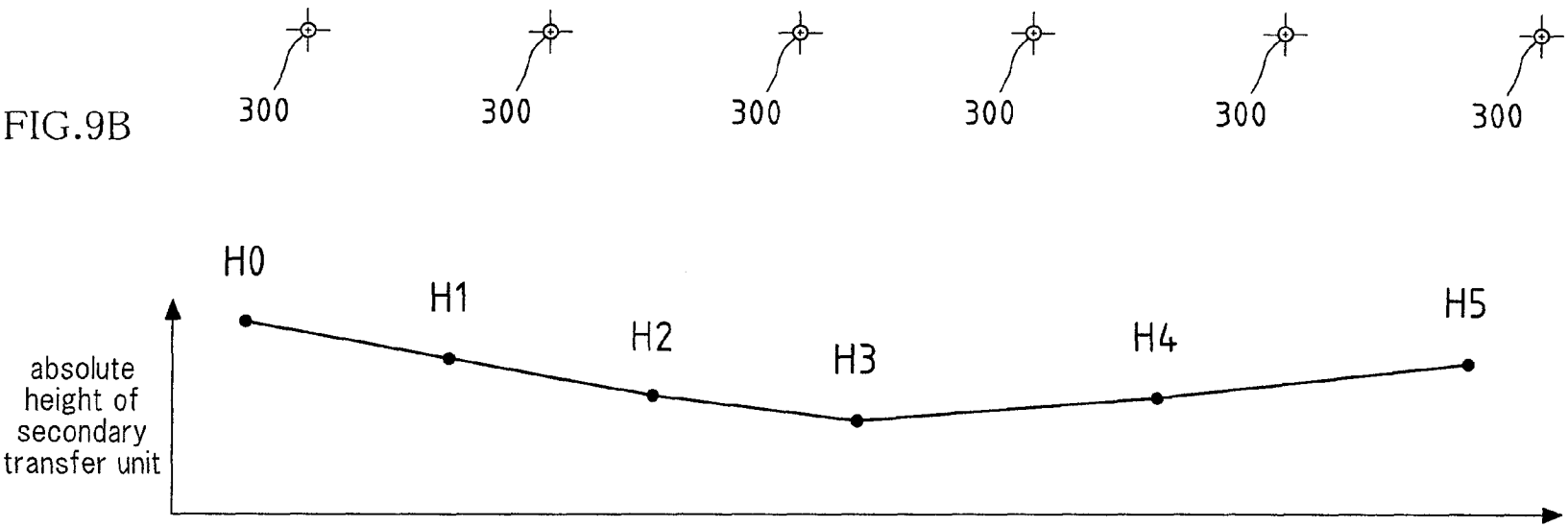
FIG. 9B shows a transition in absolute height of a secondary transfer unit during an opening operation of a fulcrum-type opening/closing cover applied in an embodiment of the present invention.

FIG. 9A shows a track in which the secondary transfer unit 10 moves due to an opening operation of the fulcrum-type opening/closing cover 214, and FIG. 9B shows a transition in absolute height of the secondary transfer unit 10 during the opening operation of the fulcrum-type opening/closing cover 214.

As shown in FIG. 9A, in a closed state α0 of the fulcrum-type opening/closing cover 214, the guide shaft 228 of the secondary transfer unit 10 has entered into the notch 232 of the guide member 230, and also the notch 238 of the positioning member 234 of the secondary transfer unit 10 is engaged with the positioning boss 236.

When the opening/closing cover 214 is rotated around a fulcrum 300 in the opening direction from this state up to a cover open angle α3 (for example, 5 degrees), the secondary transfer unit 10 rotates clockwise around the guide shaft 228, and at the time when the cover open angle of the opening/closing cover 214 has arrived at α3, the notch 238 of the positioning member 234 of the secondary transfer unit 10 is separated from the positioning boss 236. During this operation, the absolute height of the secondary transfer unit 10, as shown in FIG. 9B, gradually decreases in the manner of H0→H1(<H0)→H2(<H1)→H3(<H2), where H0 is the point of maximum height.

As shown in FIG. 9A, from the cover open angle α3 where the notch 238 of the positioning member 234 of the secondary transfer unit 10 separates from the positioning boss 236, when the opening/closing cover 214 is further rotated around the fulcrum 300 in the opening direction so that the cover open angle of the opening/closing cover 214 arrives at α4 (for example, 10 degrees), the support shaft 224 of the support shaft member 218 moves to the upper portion of the slit 226 of the secondary transfer unit 10, and the guide shaft 228 of the secondary transfer unit 10 starts to withdraw from the notch 232 of the guide member 230. During this operation, the absolute height of the secondary transfer unit 10, as shown in FIG. 9B, gradually increases in the manner of H3→H4(>H3), where H3 is the point of minimum height. Once the cover open angle α4 of the opening/closing cover 214 is passed, the guide shaft 228 of the secondary transfer unit 10 completely separates from the guide member 230.

As shown in FIG. 9A, when the opening/closing cover 214 is further rotated around the fulcrum 300 in the opening direction so that the cover open angle of the opening/closing cover 214 arrives at α5 (for example, 20 degrees), during this operation, the secondary transfer unit 10 moves following the movement track of the opening/closing cover 214. That is, after the guide shaft 228 of the secondary transfer unit 10 has completely separated from the guide member 230, the absolute height of the secondary transfer unit 10, as shown in FIG. 9B, increases in the manner of H4→H5(>H4).

Operation when Closing Opening/Closing Cover 214

When the above two types of the opening/closing cover 214 have been closed, as shown in FIG. 2, the guide shaft 228 of the secondary transfer unit 10 enters into the notch 232 of the guide member 230. At this time, the notch 238 of the positioning member 234 of the secondary transfer unit 10 engages with the positioning boss 236. Thus, in the image forming apparatus main body 110, the secondary transfer unit 10 is positioned above the transfer nip between the secondary transfer unit 10 and the intermediate transfer unit 6, and the secondary transfer unit 10 is supported by the guide member 230 below the transfer nip.

According to the present embodiment, the following operation and effects are obtained.

Figure 10:
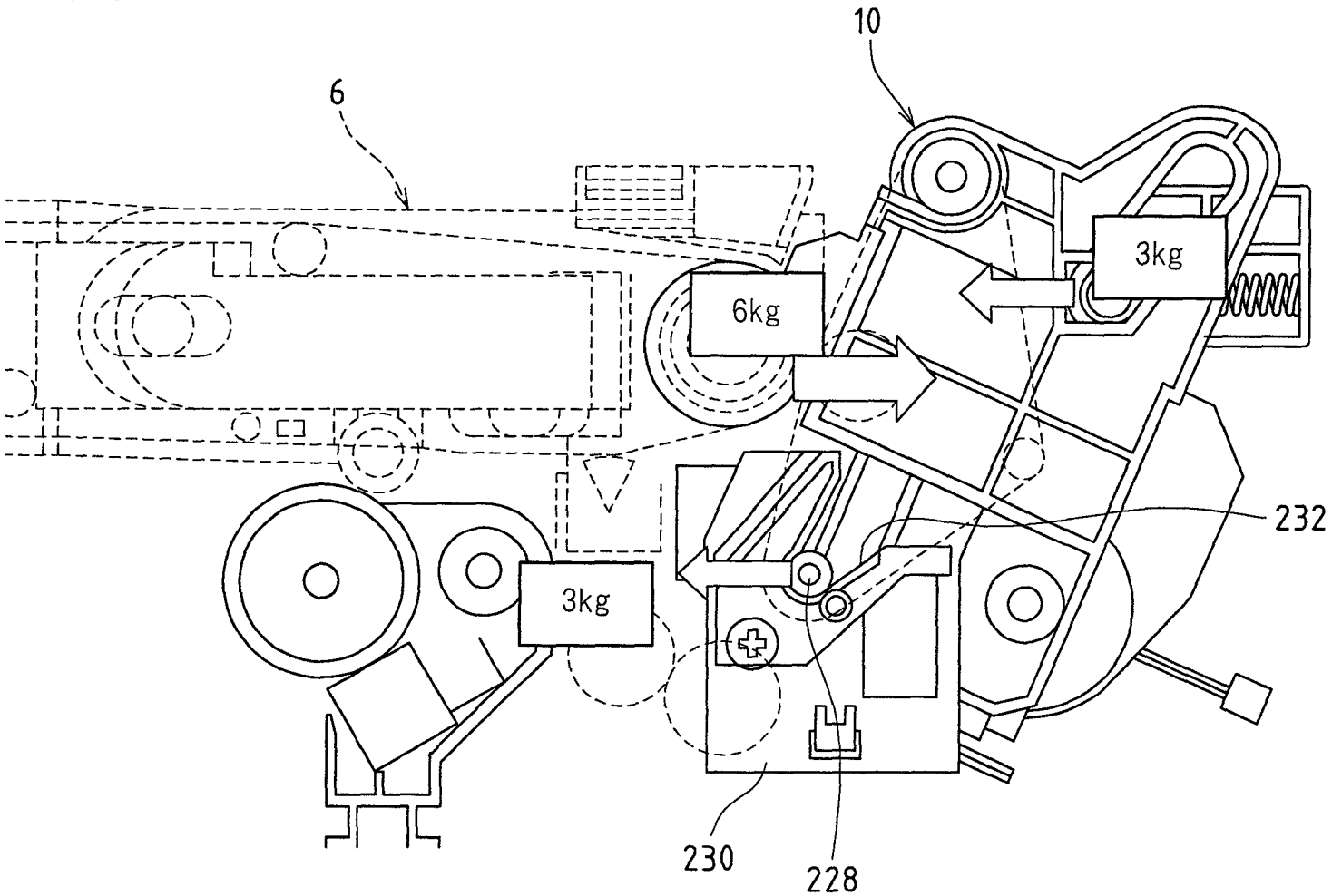
FIG. 10 graphically illustrates a state in which part of a pressing force (transfer pressing contact load) applied to a secondary transfer unit is borne on an image forming apparatus main body side.
Figure 11:
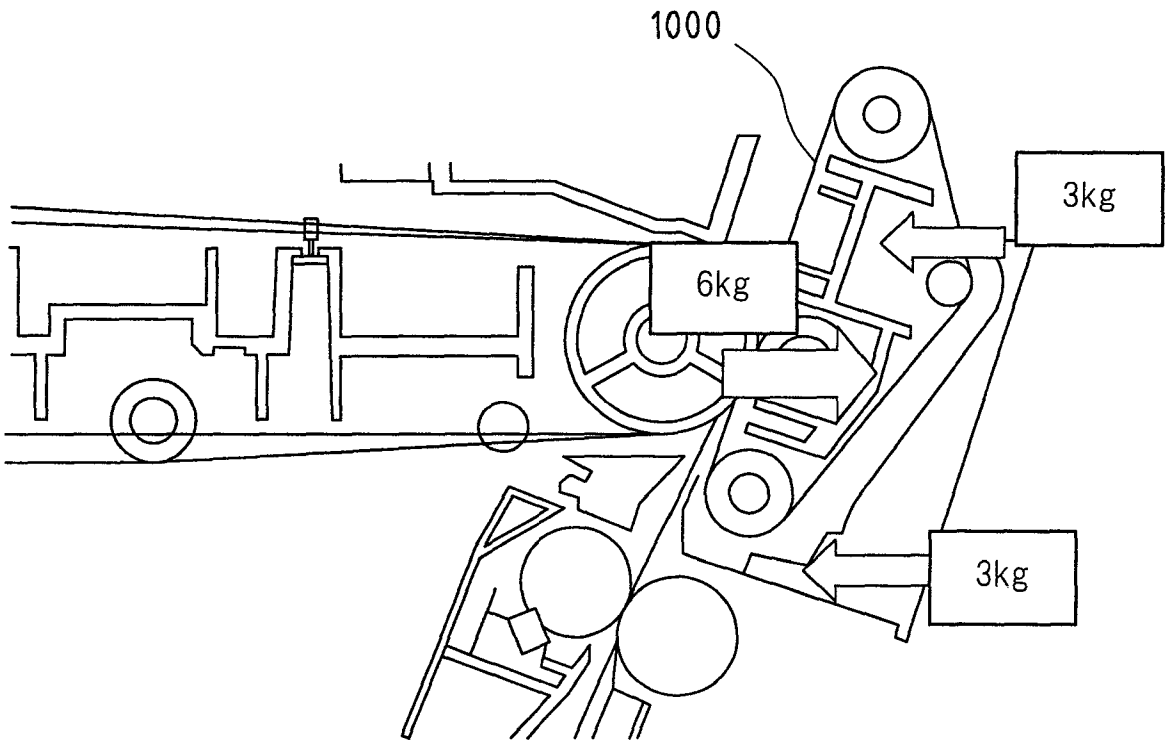
FIG. 11 graphically illustrates a state in which a pressing force (transfer pressing contact load) applied to a secondary transfer unit is borne by an opening/closing cover as-is in a conventional image forming apparatus.

(1) When the opening/closing cover 214 has been closed, it is possible to allow at least a portion of the pressing force (transfer pressing contact load) applied to the secondary transfer unit 10 to be borne on the image forming apparatus main body 110 side. Therefore, when the secondary transfer unit 10 is installed on the image forming apparatus main body 110 side of the opening/closing cover 214, it is possible to prevent deformation of the opening/closing cover 214 without achieving increased strength of the opening/closing cover 214 itself. Specifically, when the opening/closing cover 214 has been closed, the guide shaft 228 of the secondary transfer unit 10 enters into the notch 232 of the guide member 230 on the image forming apparatus main body 110 side. Accordingly, it is possible to reliably allow at least a portion of the pressing force applied to the secondary transfer unit 10 to be borne on the image forming apparatus main body 110 side. That is, because the transfer pressing contact load from the intermediate transfer unit 6 is not applied as-is to the opening/closing cover 214 from the secondary transfer unit 10, which has been installed on the image forming apparatus main body 110 side of the opening/closing cover 214, there is no risk of deformation of the opening/closing cover 214 when closing the opening/closing cover 214. As a specific example, as shown in FIG. 10, assuming that a pressing force (transfer pressing contact load) of 6 kg is applied to the secondary transfer unit 10, a load of 3 kg is applied to the opening/closing cover 214 (not shown in FIG. 10) where the secondary transfer unit 10 has been installed on the image forming apparatus main body 110 side, and a load of 3 kg is applied to the guide member 230 on the image forming apparatus main body 110 side.

(2) The opening direction P1 of the notch 232 of the guide member 230 is orthogonal to the direction P2 of operation of the pressing force received by the secondary transfer unit 10, so when closing the opening/closing cover 214, the guide shaft 228 of the secondary transfer unit 10 does not separate from the guide member 230. Accordingly, part of the pressing force received by the secondary transfer unit 10 can be efficiently borne on the image forming apparatus main body 110 side. Also, there is no loss of speed when closing the opening/closing cover 214.

(3) The secondary transfer unit 10 is held so as to be capable of swinging relative to the opening/closing cover 214, and therefore the guide shaft 228 of the secondary transfer unit 10 easily enters into the notch 232 of the guide member 230.

(4) When the opening/closing cover 214 has been closed, the secondary transfer unit 10 is positioned above the transfer unit, and the secondary transfer unit 10 is supported by the guide member 230 below the transfer nip, so the ability to bear the pressing force applied to the secondary transfer unit 10 on the image forming apparatus main body 110 side increases.

(5) The distance between the transfer nip and the point where the secondary transfer unit 10 is supported by the guide member 230 is set to be longer than the distance between the transfer nip and the point where the secondary transfer unit 10 is held by the opening/closing cover 214, and as the distance between the transfer nip and the point where the secondary transfer unit 10 is supported by the guide member 230 increases, it is possible to reduce the pressing force applied to the opening/closing cover 214 by the secondary transfer unit 10.

The present invention is not limited by the embodiment described above.

For example, in the above embodiment, an example is described in which a secondary transfer unit is installed on an image forming apparatus main body side of an opening/closing cover. However, the present invention is not limited to such a configuration. A configuration may also be adopted in which the unit installed on the image forming apparatus main body side of the opening/closing cover is, for example, a relaying unit that relays a sheet to the above-described transfer nip.

Also, in the above embodiment, an example is described in which the opening direction of a notch of a guide member is orthogonal to the direction of operation of pressing force applied to a secondary transfer unit. However, the present invention is not limited to such a configuration. Any configuration may be adopted in which the opening direction of the notch of the guide member intersects the direction of operation of pressing force applied to a secondary transfer unit.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image forming apparatus comprising:

an image forming apparatus main body;

an opening/closing member disposed on a side face of the image forming apparatus main body so as to open and close an opening of the image forming apparatus main body;

a unit installed flexibly movably on the opening/closing member;

a guided member provided in the unit; and a guide member installed in the image forming apparatus main body so as to guide the guided member when a closing operation of the opening/closing member is performed, wherein, when the closing operation of the opening/closing member is performed, the unit flexibly moves relative to the opening/closing member when the guided member is guided by the guide member, and wherein, when the opening/closing member is closed, a direction of operation of pressing force, which the unit receives from the image forming apparatus main body, faces obliquely downward on a side of the opening/closing member.

2. The image forming apparatus according to claim 1, wherein a support shaft member and a slit to guide the support shaft member are provided as a support portion to fix the unit flexibly movably to the opening/closing member.

3. The image forming apparatus according to claim 2, wherein a biasing member is provided so as to bias the support shaft member toward the image forming apparatus main body.

4. The image forming apparatus according to claim 2, wherein both sides of the unit each include the support portion.

5. The image forming apparatus according to claim 1, further comprising an image carrier and a transfer unit that transfers a toner image on a surface of the image carrier to a paper, wherein the unit is the transfer unit.

6. The image forming apparatus according to claim 5, wherein the transfer unit includes a transfer roller, and wherein, when the opening/closing member is closed, a direction of operation of pressing force that the transfer roller receives from the image carrier faces obliquely downward on the side of the opening/closing member.

7. An image forming apparatus comprising:

an image forming apparatus main body;

an opening/closing member disposed rotatably on a side face of the image forming apparatus main body so as to open and close an opening of the image forming apparatus main body;

a unit installed flexibly movably on the opening/closing member;

a guided member provided in the unit; and a guide member installed in the image forming apparatus main body so as to guide the guided member when a closing operation of the opening/closing member is performed, wherein, when the closing operation of the opening/closing member is performed, the unit flexibly moves relative to the opening/closing member when the guided member is guided by the guide member, and wherein, when the opening/closing member is closed, a direction of operation of pressing force, which the unit receives from the image forming apparatus main body, faces obliquely downward on a side of the opening/closing member.

8. The image forming apparatus according to claim 7, wherein a support shaft member and a slit to guide the support shaft member are provided as a support portion to fix the unit flexibly movably to the opening/closing member.

9. The image forming apparatus according to claim 8, wherein a biasing member is provided so as to bias the support shaft member toward the image forming apparatus main body.

10. The image forming apparatus according to claim 9, wherein both sides of the unit each include the support portion.

11. The image forming apparatus according to claim 10, further comprising an image carrier and a transfer unit that transfers a toner image on a surface of the image carrier to a paper, wherein the unit is the transfer unit.

12. The image forming apparatus according to claim 11, wherein the transfer unit includes a transfer roller, and wherein, when the opening/closing member is closed, a direction of operation of pressing force that the transfer roller receives from the image carrier faces obliquely downward on the side of the opening/closing member.

13. An image forming apparatus comprising:

an image forming apparatus main body;

an opening/closing member disposed horizontally movably on a side face of the image forming apparatus main body so as to open and close an opening of the image forming apparatus main body;

a unit installed flexibly movably on the opening/closing member;

a guided member provided in the unit; and a guide member installed in the image forming apparatus main body so as to guide the guided member when a closing operation of the opening/closing member is performed, wherein, when the closing operation of the opening/closing member is performed, the unit flexibly moves relative to the opening/closing member when the guided member is guided by the guide member, and wherein, when the opening/closing member is closed, a direction of operation of pressing force, which the unit receives from the image forming apparatus main body, faces obliquely downward on a side of the opening/closing member.

14. The image forming apparatus according to claim 13, wherein a support shaft member and a slit to guide the support shaft member are provided as a support portion to fix the unit flexibly movably to the opening/closing member.

15. The image forming apparatus according to claim 14, wherein a biasing member is provided so as to bias the support shaft member toward the image forming apparatus main body.

16. The image forming apparatus according to claim 15, wherein both sides of the unit each include the support portion.

17. The image forming apparatus according to claim 13, further comprising an image carrier and a transfer unit that transfers a toner image on a surface of the image carrier to a paper, wherein the unit is the transfer unit.

18. The image forming apparatus according to claim 17, wherein the transfer unit includes a transfer roller, and wherein, when the opening/closing member is closed, a direction of operation of pressing force that the transfer roller receives from the image carrier faces obliquely downward on the side of the opening/closing member.

* * * * *